US012604988B2

(12) United States Patent
Wu

(10) Patent No.: US 12,604,988 B2
(45) Date of Patent: Apr. 21, 2026

(54) LIFTING MECHANISM FOR ARMREST

(71) Applicant: COMFORDY CO., LTD., Tainan City (TW)

(72) Inventor: Yu-Ling Wu, Tainan City (TW)

(73) Assignee: Comfordy Co., Ltd., Tainan City (TW)

( * ) Notice: Subject to any disclaimer, the term of this patent is extended or adjusted under 35 U.S.C. 154(b) by 115 days.

(21) Appl. No.: 18/746,689

(22) Filed: Jun. 18, 2024

(65) Prior Publication Data

US 2025/0380808 A1 Dec. 18, 2025

(51) Int. Cl.
*A47C 7/54* (2006.01)

(52) U.S. Cl.
CPC ..... *A47C 7/541* (2018.08)

(58) Field of Classification Search
CPC ..... A47C 17/12; A47C 1/0303; A47C 7/541; A47C 7/543; B60N 2/76
USPC ..... 297/115, 411.36
See application file for complete search history.

(56) References Cited

U.S. PATENT DOCUMENTS 5,265,938 A * 11/1993 Melhuish ..... A47C 1/0305 297/411.36
5,676,483 A * 10/1997 Koubek ..... A47C 1/03 403/328
5,931,537 A * 8/1999 Gollin ..... A47C 1/03 297/411.27
6,062,646 A * 5/2000 Bock ..... A47C 1/0305 297/411.36
6,209,840 B1 * 4/2001 Chen ..... A47C 1/0305 248/407
6,296,312 B1 * 10/2001 Congleton ..... A47C 1/03 297/411.36
6,398,309 B1 * 6/2002 Chen ..... A47C 1/03 297/411.36
6,827,406 B2 * 12/2004 Marini ..... A47C 1/03 297/411.36
6,974,190 B1 * 12/2005 Hung ..... A47C 1/03 248/409
6,976,739 B2 * 12/2005 Wang ..... A47C 1/03 297/411.36

(Continued)

FOREIGN PATENT DOCUMENTS

DE 202024101381 U1 * 3/2024 ..... A47C 7/541
TW M421762 U 2/2012

(Continued)

*Primary Examiner* — Jose V Chen
(74) *Attorney, Agent, or Firm* — Rosenberg, Klein & Lee

(57) ABSTRACT

A lifting mechanism for armrests is provided. A control rod of a control unit is mounted in a support unit disposed in a cavity of a guide unit. Positioning balls are mounted in through holes on two sides of the support unit for being locked in or separated from positioning recesses on two side walls of the cavity. When the control rod is pulled upward for height adjustment of the armrest, the positioning balls are fallen into concave portions of the control rod and separated from the positioning recesses of the cavity. Then the support unit can be pulled for adjustment of the armrest. When the support unit is moved vertically in the cavity of the guide unit, the two positioning balls are against and contact with the two side walls of the cavity to prevent the support unit from changing directions and ensure smooth movement of the armrest.

3 Claims, 5 Drawing Sheets

(56) References Cited

U.S. PATENT DOCUMENTS 7,156,466 B1 * 1/2007 Chang ..... A47C 1/03 297/115
7,246,859 B2 * 7/2007 Igarashi ..... A47C 1/03 297/411.36
7,533,939 B2 * 5/2009 Fookes ..... A47C 1/03 297/410
7,556,316 B1 * 7/2009 Lai ..... A47C 1/03 297/411.36
7,611,206 B2 * 11/2009 Tsai ..... A47C 1/0305 297/411.36
7,770,979 B2 * 8/2010 He ..... A47C 1/0305 297/411.36
8,128,172 B2 * 3/2012 Tsai ..... A47C 1/03 297/411.36
9,004,603 B1 * 4/2015 Wang ..... A47C 1/03 297/411.36
9,861,205 B2 * 1/2018 Hector ..... A47C 7/54
10,660,445 B2 * 5/2020 Fang ..... A47C 7/541
2006/0250018 A1 * 11/2006 Tsai ..... A47C 1/0307 297/411.36
2007/0085402 A1 * 4/2007 Hu ..... A47C 1/0303 297/411.36
2008/0191537 A1 * 8/2008 Oda ..... A47C 1/03 297/411.36
2010/0066147 A1 * 3/2010 Tsai ..... A47C 1/03 297/411.36
2010/0244531 A1 * 9/2010 Pai ..... A61P 3/04 297/411.36
2012/0098318 A1 * 4/2012 Chen ..... A47C 1/03 297/411.36
2012/0104823 A1 * 5/2012 Lai ..... A47C 1/03 297/411.36
2013/0033082 A1 * 2/2013 Huang ..... A47C 1/0305 297/411.36
2013/0320739 A1 * 12/2013 Chen ..... A47C 7/54 297/411.36
2014/0183922 A1 * 7/2014 Cvek ..... A47C 1/0308 297/411.36
2015/0115683 A1 * 4/2015 Huang ..... A47C 1/03 297/411.36
2016/0088946 A1 * 3/2016 Bock ..... A47C 1/03 297/411.36
2021/0259427 A1 * 8/2021 Chen ..... A47C 7/541
2021/0315382 A1 * 10/2021 Hsieh ..... A47C 1/0305

FOREIGN PATENT DOCUMENTS

TW I519261 B 2/2016
TW M630724 U 8/2022

* cited by examiner

LIFTING MECHANISM FOR ARMREST

BACKGROUND OF THE INVENTION

Field of the Invention

The present invention relates to an armrest of chairs, especially to a lifting mechanism for armrests.

Description of Related Art

Generally, most of chairs available now are provided with armrests for allowing users to rest their arms. The armrest is usually fixed, unable to adjust its height. However, the users have different heights and shapes so that the armrest unable to be adjusted easily makes the user experience discomfort.

Thereby some chair manufacturers have developed a height adjustable armrest in Taiwanese Pat. Pub. No. 1519261, an armrest height adjustment mechanism in Taiwanese Pat. Pub. No. M630724, and an armrest height adjustment mechanism for a chair in Taiwanese Pat. Pub. No. M421762. In these prior arts, the height of the chair armrests is adjustable but they all have quite complicated structure. Thus, the production cost is high and the assembly is time consuming. These don't meet industrial requirements for low cost and high throughput. Moreover, the armrest height adjustment mechanism is designed to be positioned only on one side of the armrest. Thus, the armrest is easy to turn aside during vertical movement and further contact with and rub against a wall of a cavity for mounting the armrest. The adjustment of the armrest is not smooth.

Thus, there is room for improvement and there is a need to provide a lifting mechanism for armrests which overcome the above shortcomings.

SUMMARY OF THE INVENTION

Therefore, it is a primary object of the present invention to provide a lifting mechanism for armrests with simple structure, low cost, fast assembly, and smooth adjustment.

In order to achieve the above object, a lifting mechanism for armrests according to the present invention includes an armrest bracket, a guide unit, a support unit, and a control unit.

The armrest bracket is provided with a hollow portion therein.

The guide unit is mounted in the hollow portion of the armrest bracket and provided with a cavity and a mounting hole disposed on an upper end of the guide unit and communicating with the cavity. A plurality of positioning recesses is spaced apart from one another vertically and arranged at each of two opposite side walls of the cavity of the guide unit.

The support unit is mounted in the cavity of the guide unit through the mounting hole on the upper end of the guide unit. The support unit consists of a vertical channel formed therein and a through hole arranged at each of two opposite sides of the support unit and communicating with the vertical channel. A positioning ball is mounted in each of the two through holes. A notch is formed on one side of a top of the channel and an assembly portion is disposed on a top end of the support unit for being assembled with an armrest pad.

The control unit consists of a control rod inserted into the channel of the support unit and at least one elastic member arranged between a top end of the control rod and a bottom end of the armrest pad. The control rod is composed of a concave portion disposed on each of two opposite sides of the control rod, a guide angle formed on an upper edge of the concave portion, and a grip arranged at one side on the top end of the control rod and projecting from the notch of the support unit. By being movably mounted in or released from the two concave portions correspondingly, the two positioning balls can be locked in or separated from one of the positioning recesses on each of the two side walls of the cavity of the guide unit. Two ends of the elastic member are abutting against and positioned by the control rod and the armrest pad correspondingly.

At least one end surface of the guide unit is provided with a vertical long slot communicating with the cavity. The support unit is provided with a guide block which is disposed on at least one end surface of the support unit and mounted in the long slot of the guide unit correspondingly.

The guide unit is formed by two opposite cases connected to each other. The cavity is formed between the two cases and the mounting hole is disposed on an upper end of one of the cases.

Thereby when the control rod is pulled upward for adjustment of a height of the armrest, the positioning balls are fallen into the concave portions on the two sides of the control rod and separated from the positioning recesses on the cavity of the guide unit. Then the support unit assembled with the armrest pad can be pulled for adjustment the height of the armrest. When the support unit is moved upward or downward in the cavity of the guide unit, the two positioning balls are against and contact with the two side walls of the cavity of the guide unit. Thus, the support unit is moved upward and downward smoothly, without changing directions. Therefore, smooth movement of the armrest during adjustment is ensured.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn technical content, features, and functions of the present invention more clearly and completely, please refer to the following embodiments with related figures and reference signs.

Figure 1:
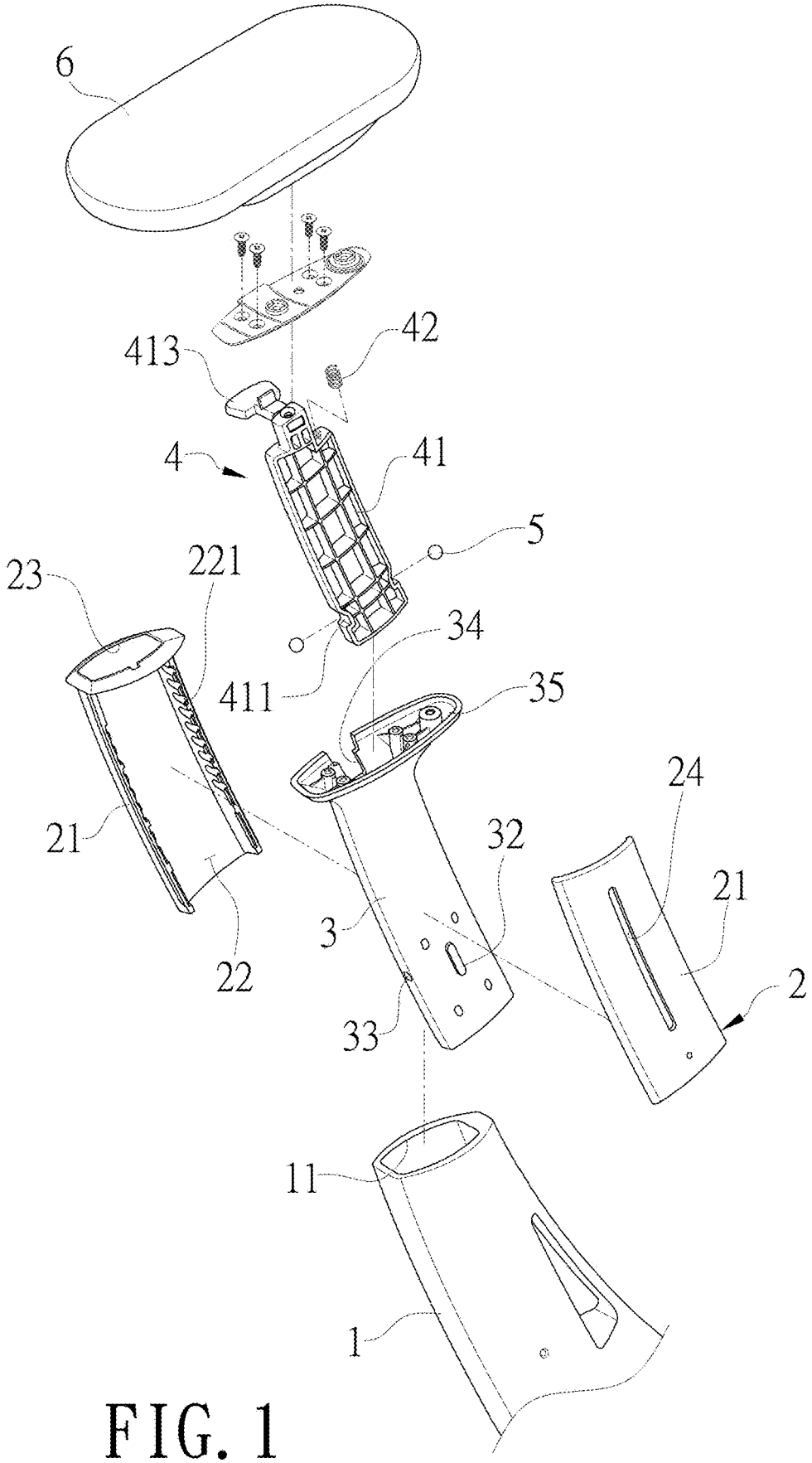
FIG. 1 is an exploded view of an embodiment according to the present invention.
Figure 2:
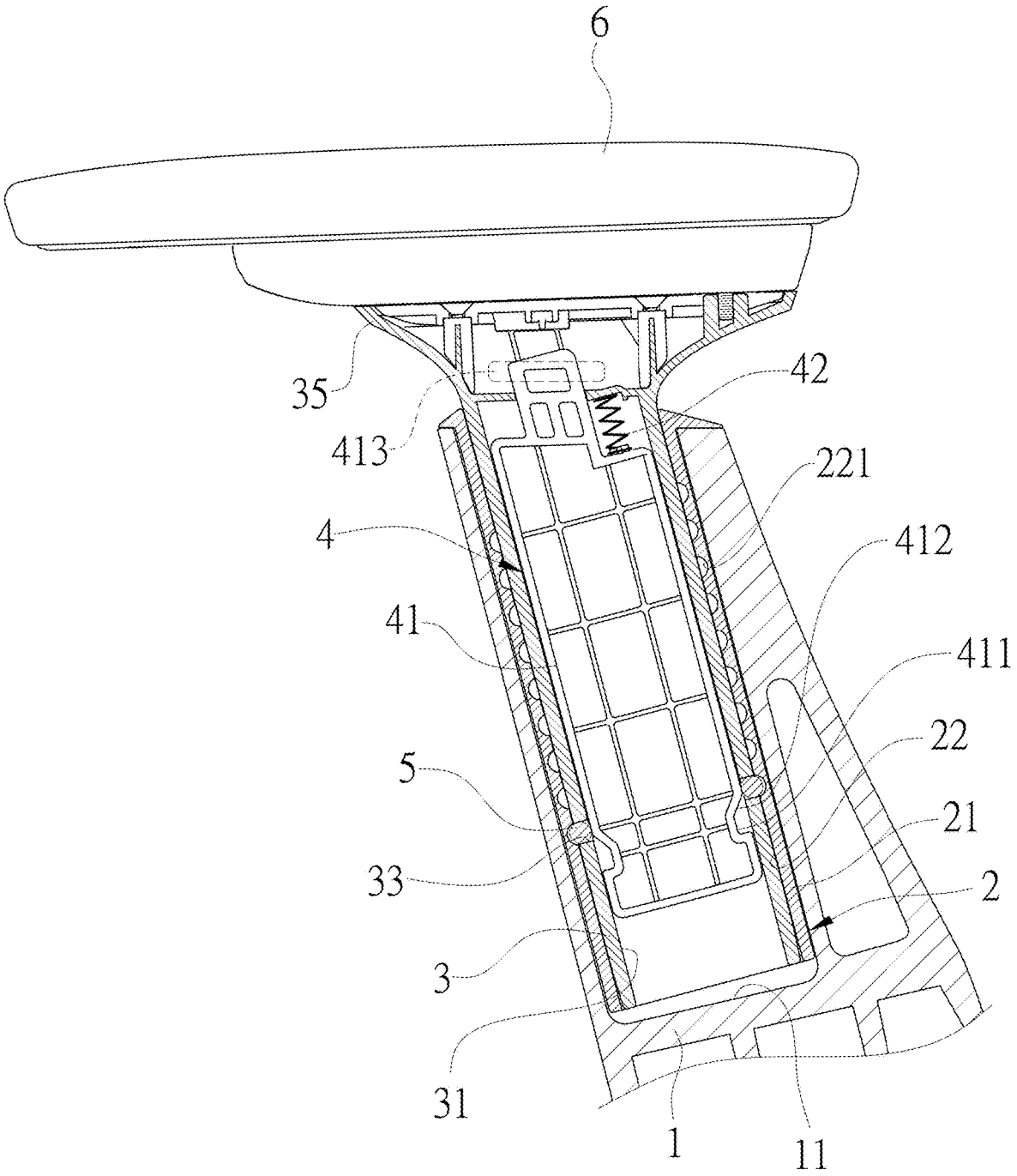
FIG. 2 is a front view of a section of an embodiment according to the present invention.
Figure 3:
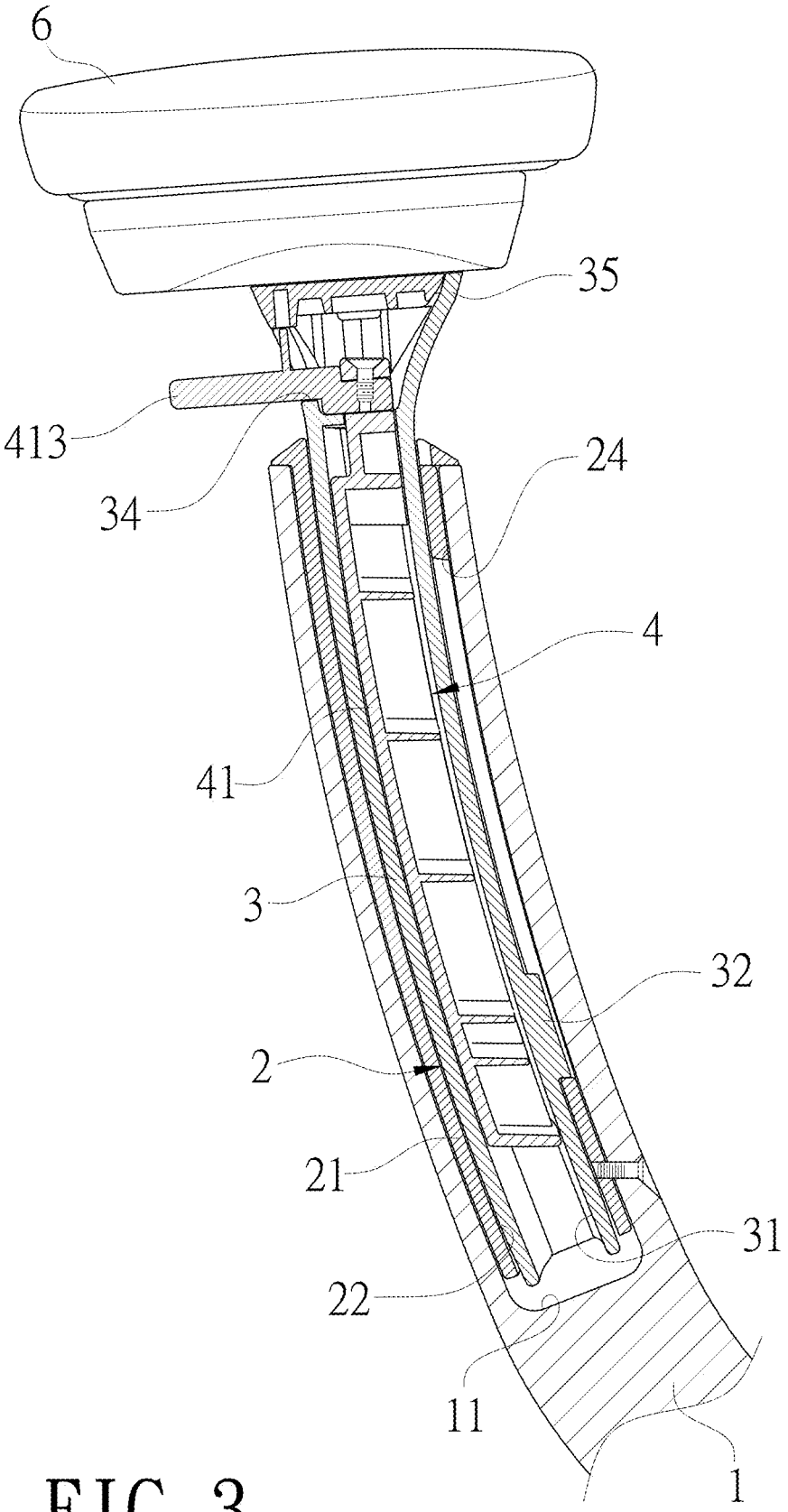
FIG. 3 is a side view of a section of an embodiment according to the present invention.

Refer to FIG. 1-3, a lifting mechanism for armrests according to the present invention mainly includes an armrest bracket 1, a guide unit 2, a support unit 3, and a control unit 4.

The armrest bracket 1 is connected to a seat of a chair and provided with a hollow portion 11 therein.

The guide unit 2 is mounted in the hollow portion 11 of the armrest bracket 1 and composed of two cases 21 opposite and connected to each other to form the guide unit 2 itself, a cavity 22 formed between the two cases 21, a mounting hole 23 disposed on an upper end of one of the cases 21 and communicating with the cavity 22, and a vertical long slot 24 formed on at least one end surface of at least one of the cases 21 and communicating with the cavity 22. A plurality of positioning recesses 221 spaced apart from one another is arranged vertically at each of two opposite side walls of the cavity 22.

The support unit 3 is mounted in the cavity 22 of the guide unit 2 through the mounting hole 23 of the case 21 of the guide unit 2. The support unit 3 consists of a vertical channel 31 formed therein, a guide block 32 disposed on at least one end surface of the support unit 3 and mounted in the long slot 24 of the guide unit 2 correspondingly, a through hole 33 arranged at each of two opposite sides of the support unit 3 and communicating with the vertical channel 31, and a notch 34 formed on one side of a top of the vertical channel 31, and an assembly portion 35 disposed on a top end of the support unit 3 for being assembled with an armrest pad 6. A positioning ball 5 is mounted in each of the through holes 33.

The control unit 4 is provided with a control rod 41 inserted into the channel 31 of the support unit 3 and at least one elastic member 42 arranged between a top end of the control rod 41 and a bottom end of the armrest pad 6. The control rod 41 is composed of a concave portion 411 disposed on each of two opposite sides of the control rod 41, a guide angle 412 formed on an upper edge of the concave portion 411 and tilting toward the concave portion 411, and a grip 413 arranged at one side on the top end of the control rod 41 and projecting from the notch 34 of the support unit 3. By being movably mounted in or released from the two concave portions 411 correspondingly, the positioning balls 5 can be locked in or separated from one of the positioning recesses 221 on each of the two side walls of the cavity 22 of the guide unit 2. Two ends of the elastic member 42 are abutting against and positioned by the control rod 41 and the armrest pad 6 correspondingly.

While being assembled, the first the control rod 41 of the control unit 4 is inserted into the channel 31 of the support unit 3. Then the elastic member 42 of the control unit 4 is disposed between the top end of the control rod 41 and the bottom end of the armrest pad 6. Next the armrest pad 6 is connected and fastened with the assembly portion 35 on the top end of the support unit 3. Then the support unit 3 is mounted in the cavity 22 of the guide unit 2 through the mounting hole 23 disposed on the upper end of one of the cases 21 of the guide unit 2 and the guide block 32 disposed on the end surface of the support unit 3 is mounted in the long slot 24 on the end surface of the case 21 of the guide unit 2 correspondingly. As to the control rod 41, it is abutted against by the elastic member 42 to move downward and make the two positioning balls 5 separate from the two concave portions 411 on the two sides of the control rod 41. And two side walls of the control rod 41 push against the two positioning balls 5 so that the positioning balls 5 at the through holes 33 of the two sides of the support unit 3 are moved outward to be locked and positioned in the positioning recesses 221 on the two side walls of the cavity 22. Later the guide unit 2, the support unit 3, and the control unit 4 already assembled with one another are mounted into the hollow portion 11 of the armrest bracket 1 and the armrest pad 6 is arranged over the armrest bracket 1. Thereby the assembly of the armrest is completed.

Figure 4:
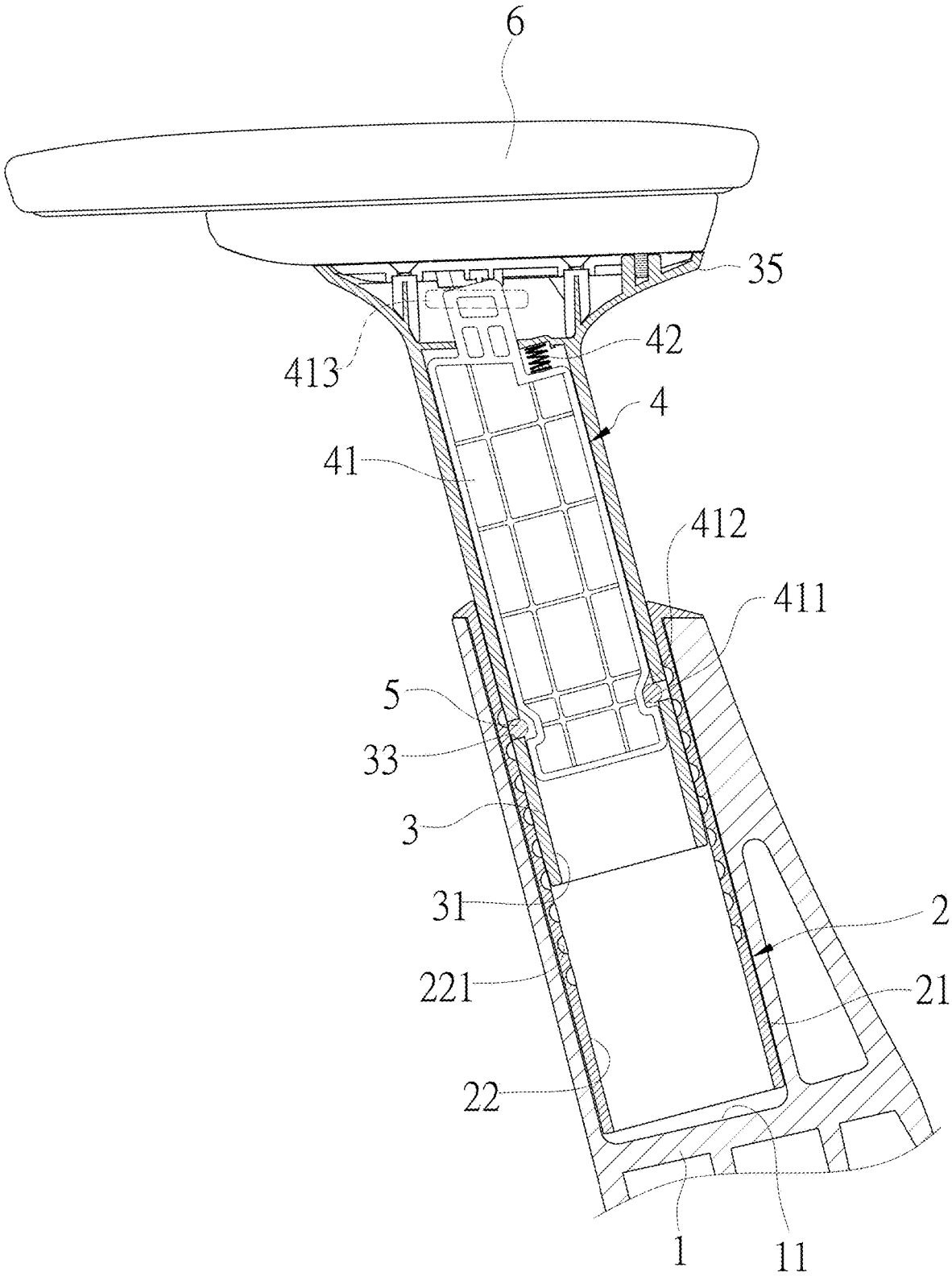
FIG. 4 is a schematic drawing showing an embodiment in use according to the present invention.

Refer to FIG. 4, when users intend to adjust a height of the armrest, the user holds the grip 413 of the control rod 41 and applies a force to pull the control rod 41 upward. While the control rod 41 being moved upward and the two concave portions 411 on the two sides thereof being moved to positions corresponding to the two positioning balls 5, the positioning balls 5 are sliding into the two concave portions 411 along the guide angles 412 on the upper edge of the concave portions 411. At the moment, the two positioning balls 5 are released from a locked state in the positioning recesses 221 on the two side walls of the cavity 22 to be mounted into the through hole 33 on the two sides of the support unit 3. Next the user holds the armrest pad 6 and applies a force to pull up or push down the support unit 3 assembled with the armrest pad 6 to a desired height. When the support unit 3 is moved upward or downward, the positioning balls 5 mounted into the through hole 33 on the two sides of the support unit 3 are in point contact with the two side walls of the cavity 22 of the guide unit 2. Thus, the support unit 3 is moved upward and downward smoothly, without changing directions to have rubbing on the wall of the cavity 22. Thereby the armrest is adjusted smoothly. Moreover, when the user applies the force to the armrest pad 6 for moving the support unit 3 upward or downward, the support unit 3 is moved under guidance of the guide block 32 located in the long slot 24 on the end surface of the guide unit 2. The smooth movement of the armrest during adjustment is ensured.

Figure 5:
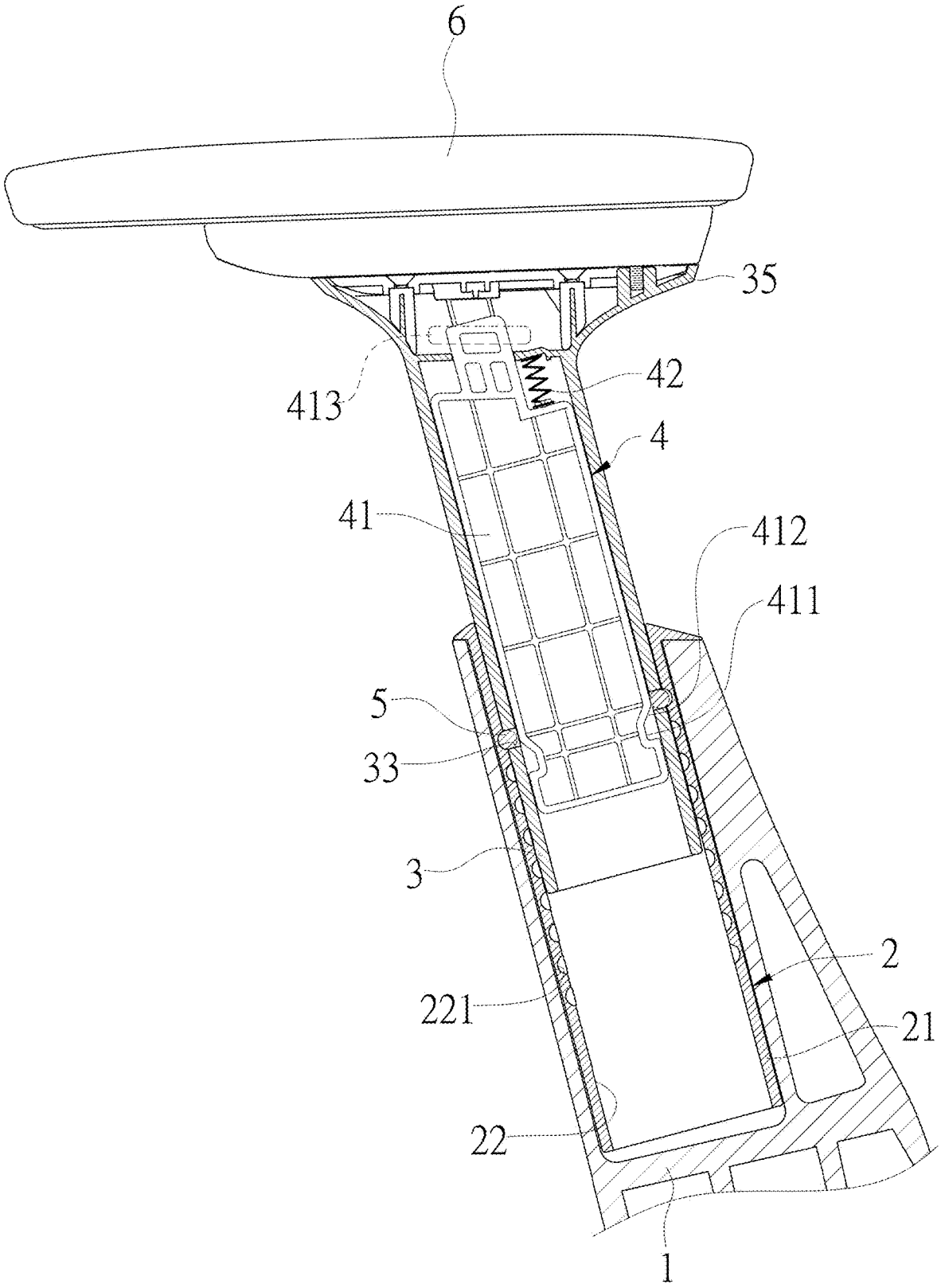
FIG. 5 is another schematic drawing showing an embodiment in use according to the present invention.

Refer to FIG. 5, when the armrest is adjusted to the desired height, the user no more applies the force to the grip 413 of the control rod 41 and the elastic member 42 compressed due to upward movement of the control rod 41 returns to its original shape and pushes the control rod 41 downward to move back. The two positioning balls 5 are sliding out of the two concave portions 411 under guidance of the guide angles 412 on the upper edge of the concave portions 411 on the two sides of the control rod 41. Then the two side walls of the control rod 41 push against the two positioning balls 5 so that the positioning balls 5 are moved outward to be locked and positioned in the positioning recesses 221 on the two side walls of the cavity 22 again and the armrest is fixed at the desired height. By the locking design between the positioning balls 5 and the positioning recesses 221 on the two side walls of the cavity 22, not only the armrest is fixed more stably, shaking of the armrest is also avoided. The user can put their arms on the armrest more comfortably.

In summary, the present lifting mechanism for armrests is quite convenient to operate. The armrest is adjusted only by pulling the control rod 41. The lifting mechanism has simple structure formed by only a guide unit 2, a support unit 3, and a control unit 4. Massive reduction in parts not only saves production cost but also makes the assembly faster and easier. The design meets industrial requirements including low cost and high productivity. Moreover, the fewer parts mean less damage to them such as falling off from the assembly. Thereby service life is increased and maintenance cost is lower.

According to the above embodiments, the present invention has the following advantages.

1. The operation of the present lifting mechanism for armrests is convenient. The armrest is lifted or lowered only by pulling the control rod.
2. The positioning balls are mounted in the through holes on two sides of the support unit. The two positioning balls are against and contact with the two side walls of the cavity of the guide unit so that changes in directions of the support unit can be avoided, without having rubbing on the wall of the cavity when the support unit is moved upward or downward. Thus, smooth movement of the armrest during adjustment is ensured.

3. The present lifting mechanism for armrests only includes an armrest bracket, a guide unit, a support unit, and a control unit. The number of the parts is significantly reduced. Thus, both production cost and assembly time are saved and industrial requirements including low cost and high productivity are met.
4. The fewer parts mean less damage to them such as falling off from the assembly so that service life of chairs is increased and maintenance cost is lower.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A lifting mechanism for armrests comprising:

an armrest bracket provided with a hollow portion formed therein;

a guide unit mounted in the hollow portion of the armrest bracket and provided with a cavity and a mounting hole disposed on an upper end of the guide unit and communicating with the cavity; a plurality of positioning recesses spaced apart from one another vertically and arranged at each of two opposite side walls of the cavity of the guide unit;

a support unit mounted in the cavity of the guide unit through the mounting hole on the upper end of the guide unit and including a vertical channel formed therein, a through hole arranged at each of two opposite sides of the support unit and communicating with the vertical channel, a notch disposed on one side of a top of the channel, and an assembly portion mounted on a top end of the support unit for being assembled with an armrest pad; a positioning ball mounted in each of the two through holes; and a control unit having a control rod inserted into the channel of the support unit and at least one elastic member arranged between a top end of the control rod and a bottom end of the armrest pad; the control rod provided with a concave portion disposed on each of two opposite sides of the control rod, a guide angle formed on an upper edge of the concave portion, and a grip arranged at one side on the top end of the control rod and projecting from the notch of the support unit; two ends of the elastic member abutting against and positioned by the control rod and the armrest pad correspondingly; when the control rod moves upward and the two concave portions on two sides thereof being moved to positions corresponding to the two positioning balls, the two positioning balls are sliding into the concave portions along the guide angles on the upper edge of the concave portions, so as further to be released from a locked state in the positioning recesses on the two side walls of the cavity of the guide unit; when the control rod being moved downward, the two positioning balls are sliding out of the two concave portions under guidance of the guide angles on the upper edge of the concave portions on the two sides of the control rod, and the two side walls of the control rod push against the two positioning balls, so that the two positioning balls are locked and positioned in the positioning recesses on the two side walls of the cavity of the guide unit.

2. The lifting mechanism for armrests as claimed in claim 1, wherein at least one end surface of the guide unit is provided with a vertical long slot communicating with the cavity; a guide block is disposed on at least one end surface of the support unit and mounted in the long slot of the guide unit correspondingly.

3. The lifting mechanism for armrests as claimed in claim 1, wherein the guide unit is formed by two opposite cases connected to each other; the cavity is formed between the two cases and the mounting hole is disposed on an upper end of one of the cases.

* * * * *